US007735440B2

(12) United States Patent
Corboy et al.

(10) Patent No.: US 7,735,440 B2
(45) Date of Patent: Jun. 15, 2010

(54) INFLATABLE RESTRAINT FOR MISSILES AND MISSILE CANISTERS

(75) Inventors: Grant W. Corboy, Baltimore, MD (US); Michael J. Shaffer, Bel Air, MD (US); Mahendra Maheshwari, Forest Hill, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 2359 days.

(21) Appl. No.: 10/283,242

(22) Filed: Oct. 30, 2002

(65) Prior Publication Data

US 2003/0226771 A1 Dec. 11, 2003

Related U.S. Application Data

(60) Provisional application No. 60/385,914, filed on Jun. 6, 2002.

(51) Int. Cl.
*B63B 1/00* (2006.01)
*B63B 5/00* (2006.01)

(52) U.S. Cl. ..... 114/238; 248/311.2; 89/1.81; 89/1.816

(58) Field of Classification Search ..... 248/311.2, 248/313, 316.2, 506; 89/1.801, 1.806; 102/343, 102/349, 358; 114/20.1, 238
See application file for complete search history.

(56) References Cited

U.S. PATENT DOCUMENTS 5,375,898 A * 12/1994 Ohmori et al. ..... 294/88
5,626,229 A 5/1997 Dickie et al.
5,704,579 A * 1/1998 Celentino et al. ..... 248/311.2
5,791,618 A * 8/1998 Lancaster ..... 248/311.2
5,942,712 A * 8/1999 Mello ..... 89/1.811
6,302,364 B1 * 10/2001 Chiueh ..... 248/311.2
6,637,617 B2 * 10/2003 Eisenbraun et al. ..... 220/720
6,834,838 B2 * 12/2004 Dennis et al. ..... 248/311.2
7,128,013 B1 * 10/2006 Plunkett et al. ..... 114/238
2002/0101197 A1 * 8/2002 Lys et al. ..... 315/291

OTHER PUBLICATIONS

PNEUMA-GRIP illustration from Presray Corporation catalog.

* cited by examiner

*Primary Examiner*—Gwendolyn Baxter
(74) *Attorney, Agent, or Firm*—Schwegman, Lundberg & Woessner, P.A.

(57) ABSTRACT

An inflatable restraint, and method of using the same, is used to provide support and shock isolation for missiles, torpedoes, missile canisters or the like in naval vessels. The inflatable restraint features a structural collar, at least one inflatable bladder and at least one interference member. The interference member is attached to the inside of the structural collar and the interference member is fully adjustable to ensure a snug fit during the loading of the missile, torpedo or missile canister into the structural collar. Once the missile, torpedo, missile canister or the like is properly inserted into the structural collar, the at least one inflatable bladder, which is also attached to the inside of the structural collar, is inflated to restrain the object. The pressure of the inflatable bladder may be regulated to provide variable spring constants and stiffness.

8 Claims, 6 Drawing Sheets

INFLATABLE RESTRAINT FOR MISSILES AND MISSILE CANISTERS

CROSS-REFERENCE TO RELATED APPLICATION

This application claims the benefit of U.S. Provisional Application Ser. No. 60/385,914 filed Jun. 6, 2002, and which is incorporated herein by reference.

FIELD OF INVENTION

The invention relates to missiles and missile launchers, and more particularly, to the use of a pneumatic bladder or inflatable membrane to support a missile or missile canister and for providing resonant tuning of the support to different spring constants and stiffness through modification of the pressure within the bladder.

BACKGROUND OF THE INVENTION

The loading of missiles, torpedoes, canisters or the like into naval vessels is often a time consuming task. There are two areas of concern for support of missiles: the support of the canister (the item which surrounds and protects the missile), and the support of the missile inside the canister.

For surface ships, a vertical launch structure supports the missile canister. These canisters are locked into the structure using an apparatus to rigidly connect and align the aft end of the canister. This apparatus is called a "Dog-Down". The Dog Down mechanism is a mechanical screw driven device with tapered wedges. These tapered wedges interface with a female receiver located on the missile canister. The tapered wedges on the Dog Down are drawn together by means of a reverse threaded shaft. This shaft, that passes through the wedges cause the wedges to move toward one another when the shaft is turned. The tapered wedges interface with the female receptacles on the missile canister, pushing the canister downward and sealing against the plenum surface on the launcher. Due to the rigid connection of the canister at the top of the launcher and at the dog-down interface, the entire launcher must be isolated from the ship to ensure shock loads are not transmitted to the missile round. This is a costly solution to the problem. Having a restraint mechanism at the launcher to canister interface would greatly simplify launcher designs and ship compatibility.

For submarines, pads are located on the canister itself for isolation. The launch structure within a submarine is directly connected to a launch tube (no isolation between ship and launcher). Within the launch tube are raised pads whose location coincides with the isolation pads located on the missile canister. The pads, which have tapered-edges and a low friction coating, aid in the installation of the canister in the launch tube. The missile canister is constrained within the launch tube by a connection at the top. Also along the height of the canister are raised rubber pads that interfere with the raised edges in the launch tube, creating an interference fit. This fit provides the lateral support for the canister, and isolates the missile canister from the rest of the launch structure. A hydraulic jack is used to insert the missile canister into the launch tube. Due to the number of pads and the amount of surface area of interference, loads required to insert the missile canister can be as high as 40,000 lbs. In addition to the large loads required to install the missile canister, the time required to mobilize the equipment and insert the canister may be as long as 3 hours per missile. Also, during the hydraulic jacking process, the pads on the missile canister can pop off, jamming between the missile canister and launch tube preventing complete installation.

For missile support, either sabots or snubbers are used to support the missile inside the canister. A sabot is a carrier inside the missile canister that provides support to the missile during shipping and transportation as well as during missile egress. The sabots are usually spring loaded against the missile and upon missile exit from the canister are ejected away from the missile. The sabots create a problem in ripple firing scenarios, since the ejected sabots could be in the flight trajectory of adjacent missiles. Snubbers, on the other hand, are retractable mechanisms within the canister that support the missile during shipping and transportation and fold down out of the way during launch, but always stay inside the canister. Snubbers are mechanical devices that have complex linkages that have reliability issues. In addition, since these linkages are rigid, loads outside the canister are transmitted directly into the missile.

Other known art relies upon passive support, meaning it inflates once and is left alone. Also, because of material selection and support provided to the bladder, other known techniques can only operate at low pressures. The present invention is an active support and can operate at high pressures in excess of 200 pounds per square inch due to the combination of having a support structure and the use of reinforced fabrics. The support structure comprises the recessed groove of our design and supports the top, bottom and back of the bladder. The front of the bladder is supported by the canister or missile.

The inflatable restraint in some fashion addresses all of the shortcomings associated with canister and missile support. The present invention is a constraining/clamping isolator that mitigates the need for having the launch structure entirely isolated. Isolation is occurring locally at the clamping interface by inflatable bladders. Also, when the bladders are deflated, ample clearance exists such that the missile canister no longer has to be hydraulically jacked into the launch tube as needed in the underwater launch configuration. The canister can simply be dropped in and the bladders inflated. For missile restraint, inflatable pads can replace the sabots. In this case, the invention behaves more like a snubber, but without the complicated linkages and the excessive load transfer into the missile.

SUMMARY OF THE INVENTION

The present invention is an inflatable restraint used to provide support and shock isolation when securing missiles, torpedoes, canisters, or the like into a naval vessel. The inflatable restraint features a structural collar, with an inside and outside surface, having a perimeter and thickness. The inside surface of the structural collar has at least one recessed groove with at least one inflatable bladder lying within the groove. The inside surfaces of the structural collar features an interference member for the purpose of substantially aligning an object within the structural collar. A pressure regulator can regulate and change the spring stiffness of the inflatable bladder based on the shock requirements of the missile. The pressure regulator is operatively coupled to the inflatable bladder and a pressure source to pressurize and to inflate the bladder.

BRIEF DESCRIPTION OF THE DRAWINGS

The above and other advantages and features of the present invention will be better understood from the following detailed description of the preferred embodiments of the invention, which is provided in connection with the accompanying drawings. The various features of the drawings may not be to scale. Included in the drawing are the following figures.

DETAILED DESCRIPTION

Figure 1:
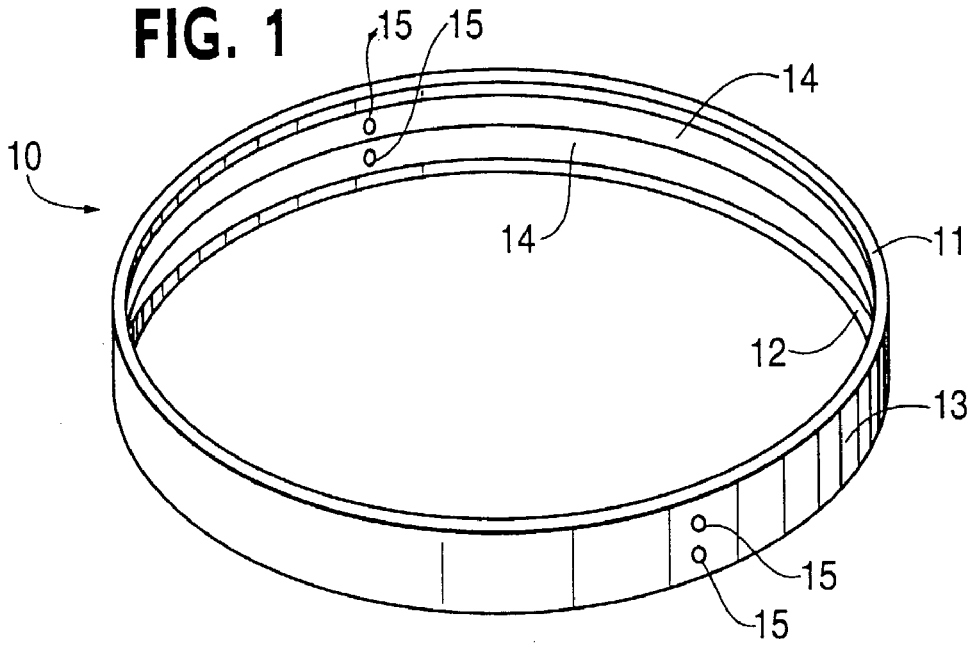
FIG. 1 is a perspective view of a structural collar of the present invention.

FIG. 1 is a perspective view of the inflatable restraint 10 wherein a structural collar 11 has an inside surface 12 and an outside surface 13, at least one recessed groove 14, and at least one hole 15. While the inflatable restraint 10 is shown as being substantially circular in shape, other shapes would not depart from the scope of the present invention. For example, the structural collar 11 may be any type of uniform or non-uniform geometry such as, but not limited to, a polygon, depending upon the type of object (e.g. missile, torpedo, missile canister) with which the structural collar 11 is to be used. The structural collar 11, as shown in FIG. 1, is, preferably, of unitary construction having a thickness and perimeter. The thickness of the structural collar is defined as the measurement between the inside surface 12 and the outside surface 13. Additionally, the structural collar 11 is made from a material that is known for being rigid and sturdy such as, (but not limited to), steel, or titanium.

Recessed groove 14 is formed during the manufacture of the structural collar 11, but in other embodiments the recessed groove 14 may be cut into the inside surface 12 of structural collar 11 after its manufacture. Recessed groove 14 protects an inflatable bladder (not shown in FIG. 1) when an object is loaded into the structural collar 11. It is to be understood that recessed groove 14 is continuous. While FIG. 1 shows the inflatable restraint 10 with two recessed grooves 14, one would realize that any number of recessed grooves 14 may be on the inside surface 12 of the structural collar 11. If more than one recessed grooves 14 are featured, they are substantially parallel to each other.

The structural collar 11 also features hole 15 that is cut through inner surface 12 and the outer surface 13 and around the perimeter of the structural collar 11. Hole 15 allows a pressure regulator (not shown in FIG. 1) to attach, by means well known within the art, to an inflatable bladder (not shown in FIG. 1). For example, hole 15 may be threaded allowing for a pressure regulator and inflatable bladder to attach to each other.

Figure 2:
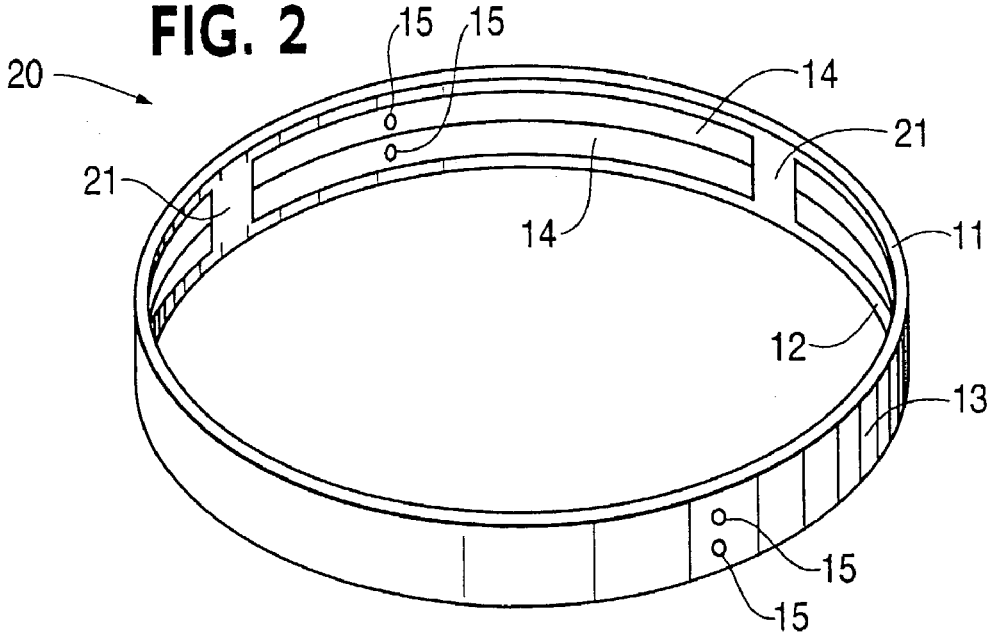
FIG. 2 is a perspective view of an alternative embodiment of the structural collar of the present invention.

FIG. 2 is a perspective view of an alternative embodiment of the inflatable restraint 20 wherein the structural collar 11 has an inside surface 12, an outside surface 13, at least one recessed groove 14, at least one hole 15, and at least one mounting plate 21. While the inflatable restraint 20 is shown as being substantially circular in shape, other shapes would not depart from the scope of the present invention. For example, the structural collar 11 may be any type of uniform or non-uniform geometry such as, but not limited to, a polygon, depending upon the type of object (e.g. missile, torpedo, missile canister) with which the structural collar 11 is to be used. The structural collar 11, as shown in FIG. 2, is, preferably, of unitary construction having a thickness and perimeter. The thickness of the structural collar is defined as the measurement between the inside surface 12 and the outside surface 13. Additionally, the structural collar 11 is made from a material that is known for being rigid and sturdy such as, but not limited to, steel, titanium, or the like.

Recessed groove 14 is formed during the manufacture of the structural collar 11, but in other embodiments the recessed groove 14 may be cut into the inside surface 14 of structural collar 11 after its manufacture. Recessed groove 14 protects an inflatable bladder (not shown in FIG. 2) when an object is loaded into the structural collar 11. It is to be understood that recessed groove 14 is not continuous since mounting plate 21 is on the inside surface 12 of the structural collar 11. While FIG. 2 shows the inflatable restraint 20 having two recessed grooves 14, one of ordinary skill would realize that any number of recessed grooves 14 may be on the inside surface 12 of the structural collar 11 and, preferably, if more than one recessed grooves 14 are featured, recessed grooves 14 are substantially parallel to each other.

The structural collar 11 also features hole 15 that is cut through inner surface 12 and the outer surface 13 and around the perimeter of the structural collar 11. Hole 15 allows a pressure regulator (not shown in FIG. 1) to attach, by means well known within the art, to an inflatable bladder (not shown in FIG. 2). For example, hole 15 may be threaded allowing for a pressure regulator and inflatable bladder to attach to each other.

Figure 3:
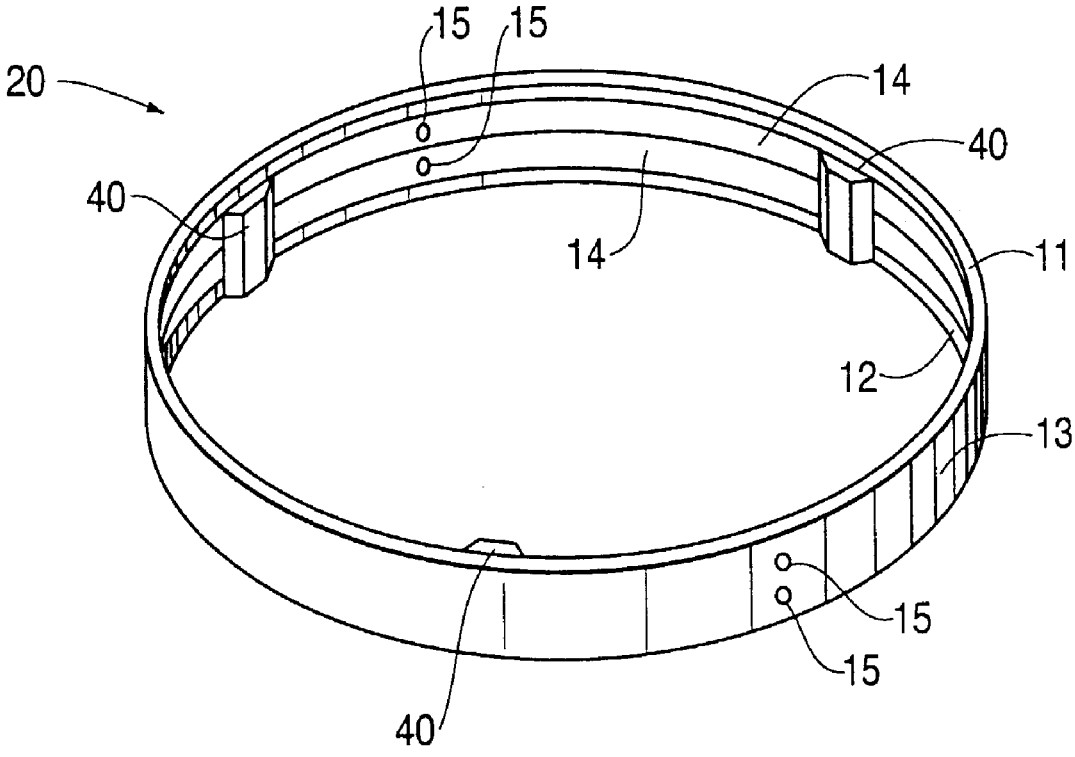
FIG. 3 is a perspective view of a structural collar of the present invention.

FIG. 3 shows the inflatable restraint 10 or 20, as described above, having at least one interference member 40 attached thereto. The interference member 40, which is discussed in further detail below, may be attached anywhere on the inside surface 12 of the structural collar 11 of the inflatable restraint 10 or, in the alternative embodiment, interference member 40 attaches to mounting plate 21. While FIG. 3 shows that three interference members 40 are attached to the structural collar 11, any number of interference members 40 may be attached to the structural collar 11 without departing from the spirit of the present invention.

The interference member 40 attaches to structural collar 11 by means well known within the art. For example, interference member 40 may be threadedly attached to structural collar 11. In other embodiments, the interference member 40 may snap onto the structural collar 11.

Figure 4A:
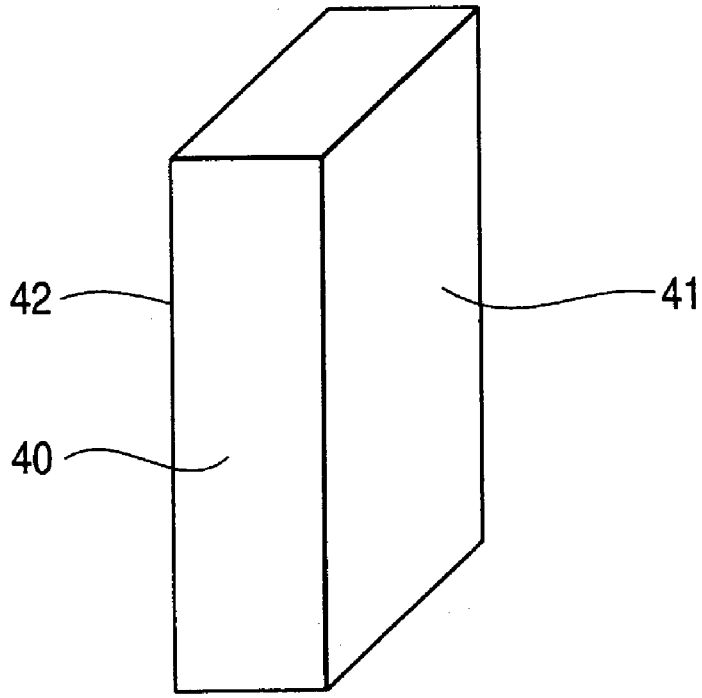
FIG. 4*a* is a perspective view of an interference member of the present invention.

FIG. 4*a* describes a perspective view of interference member 40 featuring connector 41 and front side 42. Interference member 40 can be the shape of any polygon and is manufactured from a rigid and sturdy material such as, but not limited to, steel, titanium, or the like.

Preferably, when an object (not shown) is inserted into the structural collar 11, interference member 40 aligns the object ensuring that the object is only in contact with the at least one interference member 40 and not the inside surface 12 of the structural collar or the at least one inflatable member (not shown). The interference member 40, in addition to aligning the object within the structural collar 11, prevents the object from damaging the inflatable bladder.

Interference member 40 also features connector 41 allowing the interference member 40 to attach to the inside of the structural collar 11. For example, connector 41 may be a threaded hole in the back of interference member 40 or connector 41 may allow the interference member 40 to connect to structural collar by means of a snap connection. Regardless of the type of connector 41 that is used to attach interference member 40 to structural collar 11, connector 41 also allows the interference member 40 to be adjustable through either a manual or automatic means.

Figure 4B:
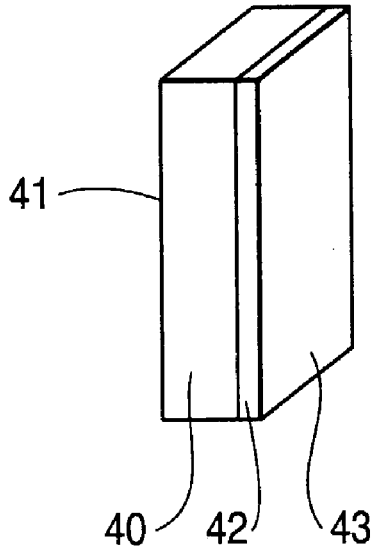
FIG. 4*b* is a perspective view of an alternative embodiment of the interference member.

FIG. 4*b* shows a perspective view of the interference member 40 having a rubber cover 43 attached to its front side 42. When an object is inserted into the structural collar 11 configured with the interference member 40 of FIG. 4*b*, the object substantially touches rubber cover 43 thereby providing a friction fit between the object and interference member 40. In other embodiments, since interference member 40 is adjustable, after the object is inserted into the structural collar 11, the interference member 40 may be adjusted radially in order to provide a friction fit between the object and interference member 40 by means of the rubber cover 43. While the term rubber is used, other materials known within the art may be used that are compressible.

Figure 4C:
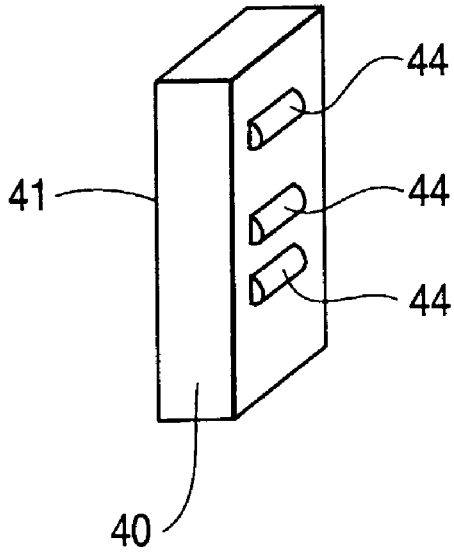
FIG. 4*c* is a perspective view of an alternative embodiment of the present invention.

FIG. 4*c* shows a perspective view of the interference member 40 having at least one roller 44 attached to the front side 42 of the interference member 40. Preferably, roller 44 is spring loaded allowing roller 44 to move in a radial direction with respect to the structural collar 11. This alternative embodiment is, preferably, used with a structural collar 11 having an alignment pin (not shown), which is described below. As an object is inserted into the structural collar 11, the roller 44 is substantially in contact with the object and roller 44 may move since it is spring loaded, as is well known in the art.

Figure 5:
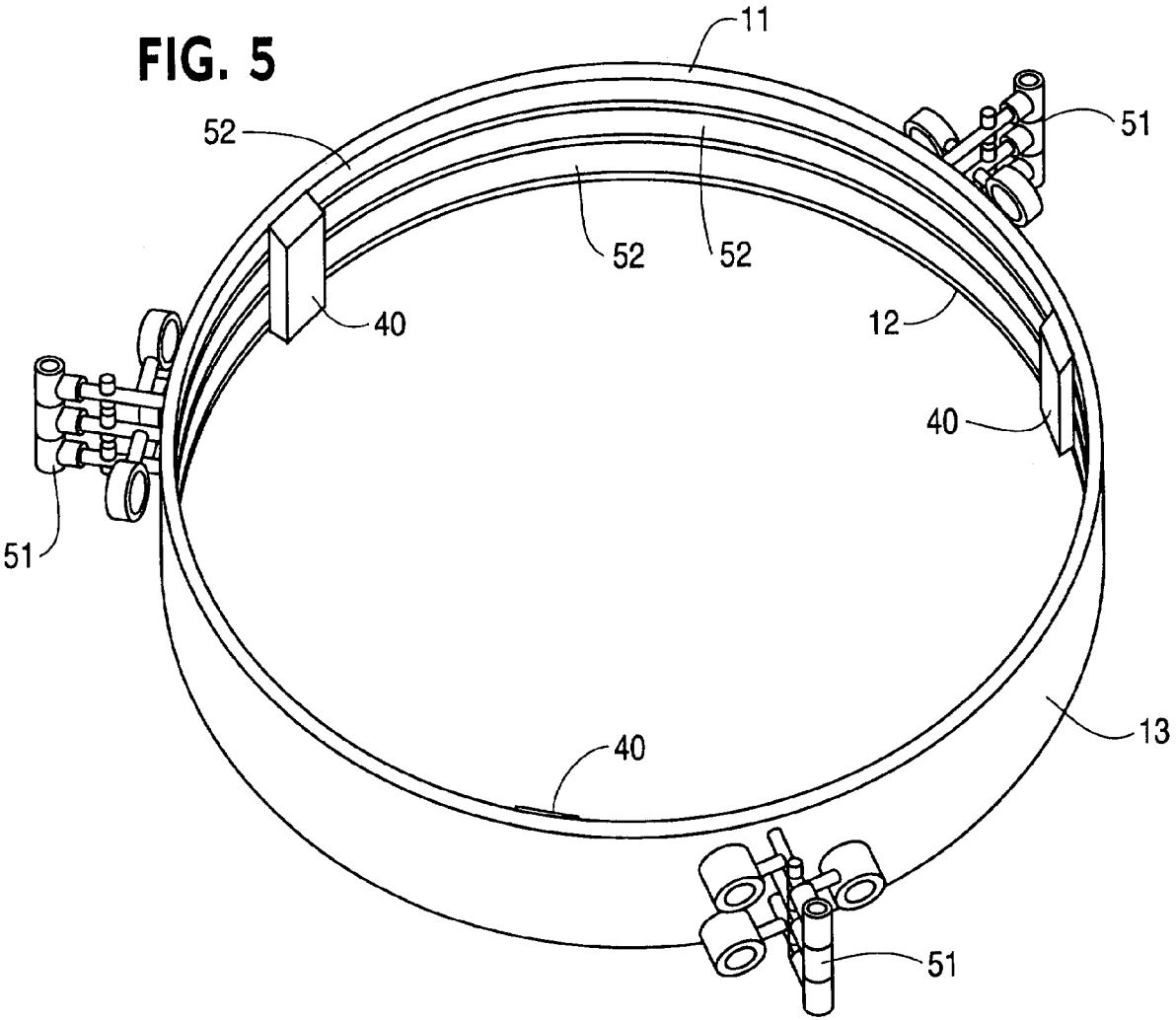
FIG. 5 is a perspective view of the inflatable restraint.

FIG. 5 details the inflatable restraint 10 or 20, as described above, having at least one pressure regulator 51 and at least one inflatable bladder 52. Pressure regulator 51 is a conventional pressure regulator adapted to be used with inflatable restraint 10. It is to be understood that pressure regulator 51 is operatively coupled to both a source (e.g. compressed air) and inflatable bladder 52. The coupling may be any means well known within the art such as, but not limited to, a threaded or snap-like connection.

Inflatable bladder 52 is attached to the inside surface 12 of structural collar 11 within a recessed groove 14 (not shown in FIG. 5). Inflatable bladder 52 can be attached to the structural collar 11 by means of an adhesive tape, rubber contact cement, stitches or retained by mechanical fasteners at the ends of the inflatable bladder 52. The inflatable bladder 52 can be made from various materials such as, but not limited to, silicon, rubber, or a urethane coated fabric depending on the restrain and wear requirements. A variety of reinforcing fabrics may be used to increase the capacity of the inflatable bladder 52. The reinforcing fabrics add additional strength to the inflatable bladder 52 in order for the present invention to operate under extreme conditions and reduce the wear of the inflatable bladder.

Since the inflatable bladder 52 has a low modulus, it tends to have excellent isolation characteristics. Additionally, the aforementioned materials are ideal for shock isolation, where shock attenuation is the main goal. The size of the inflatable bladder is based upon shock analysis where the support area (contact area), load, and stiffness dictate the size and type of bladder. FIG. 5 details the use of discontinuous inflatable bladders 52 since each inflatable bladder 52 begins and ends next to interference member 40. Since the inflatable bladder 52 is discontinuous, if an inflatable bladder 52 is damaged, it would be easy and less costly to replace. While a discontinuous inflatable bladder 52 is preferred, the inflatable restraint 10 may use at least one continuous inflatable bladder. Additionally, discontinuous inflatable bladders 52 are optimal when the structural collar 11 is a polygon.

Figure 6:
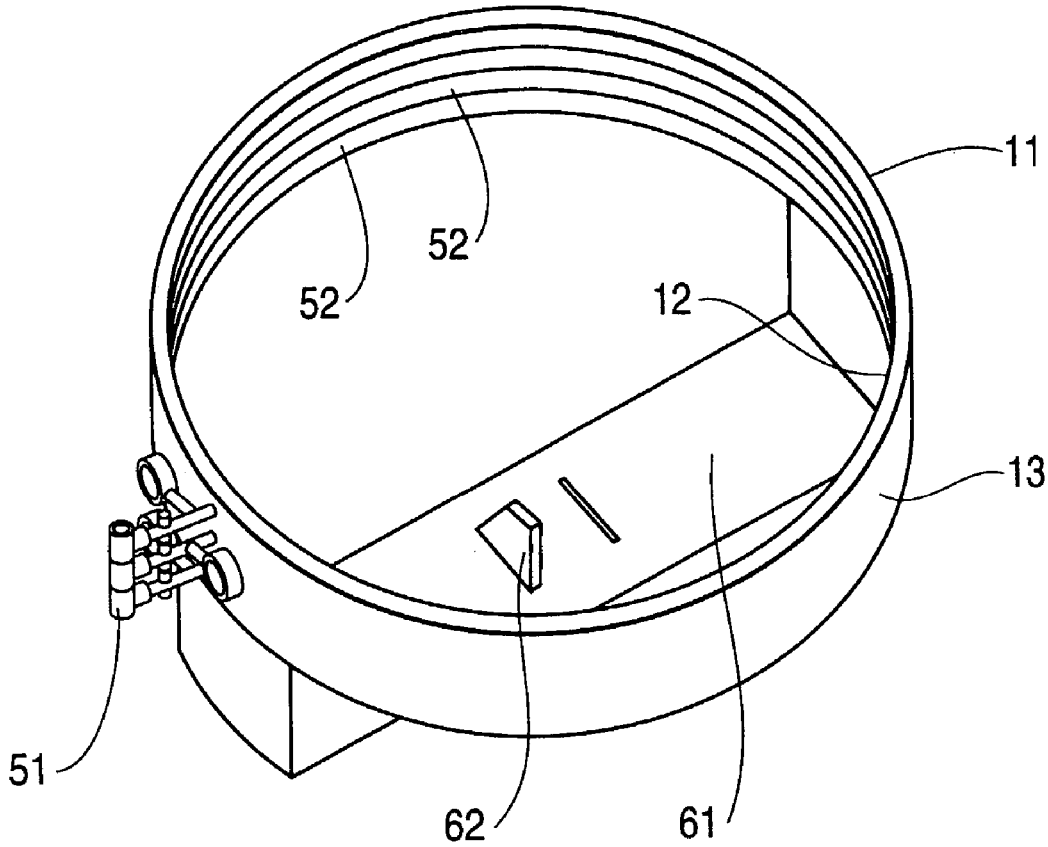
FIG. 6 is a perspective view of the inflatable restraint with alignment pin.

FIG. 6 details inflatable restraint 10 or 20 having structural collar 11 wherein inflatable bladder 52 is within a recessed groove (not shown in FIG. 6) on the inside surface 12 of inflatable restraint 10 or 20. While the inflatable bladder 52 is shown in FIG. 6 as being substantially continuous, in other embodiments, the inflatable bladder 52 can be discontinuous allowing for a plurality of inflatable bladders 52 to be used.

Alignment system 61 is attached to structural collar 11 by means well known within the art. As shown in FIG. 6, alignment system features a male connector 62 and the object (not shown if FIG. 6) features a female connection. In other embodiments, the alignment system can feature a female connector and the object has a male connector.

Figure 7A:
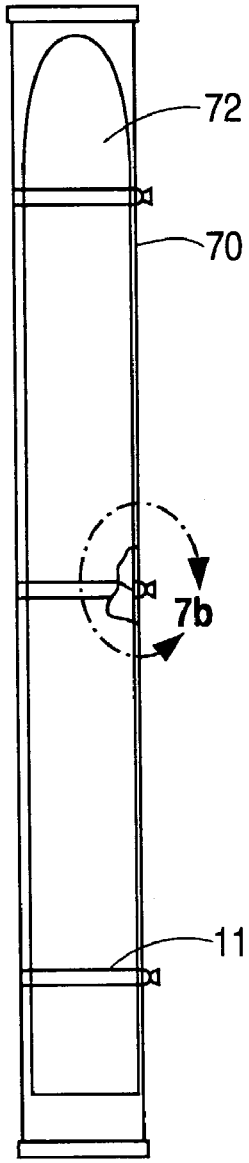
FIG. 7 shows a missile in a canister and in an exploded view the missile being constrained by the inflatable bladder.
Figure 7B:
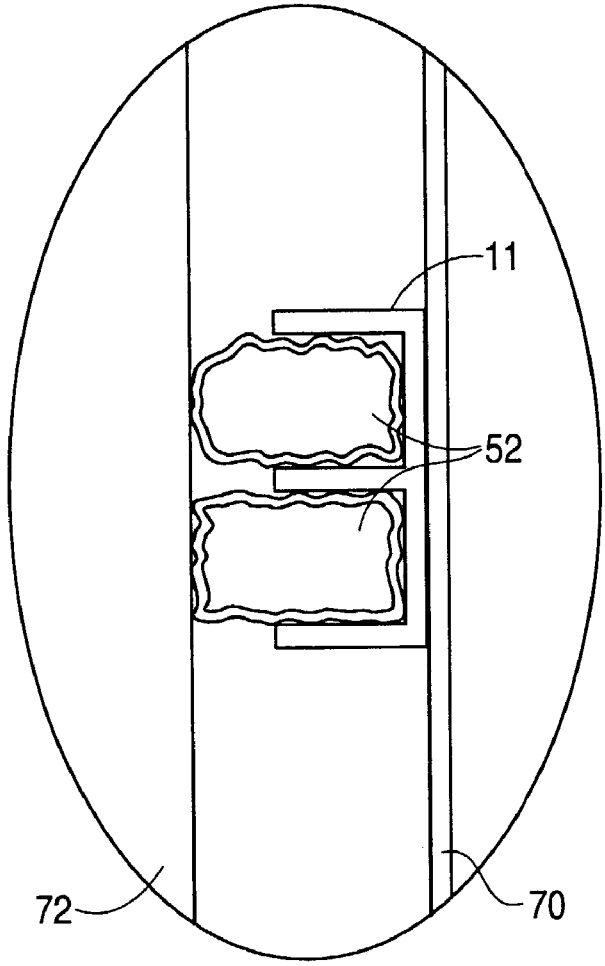

In order to use the inflatable restraint 10 or 20, an object, such as a missile 72, shown within a canister 70 in FIG. 7, is inserted into the structural collar 11. Preferably, when inserted, the missile 72 is substantially in contact with interference member 40 not shown. Inflatable bladder 52 is then inflated to constrain the missile 72 within canister 70. The pressure of inflatable bladder 52 can be regulated to change the spring stiffness of the inflatable bladder based on the shock requirements of the missile. This can be done manually or under computer control known in the art. In other embodiments, once the object is inserted, interference member 40 is adjusted, by means well known in the art, in order to substantially touch the object. Next, the user operates the pressure regulator 51 causing inflatable bladder 52 to inflate and hold the object in place. Once the inflatable bladder 52 is inflated to its desired level, the inflatable restraint system 10 or 20 may support the object in either a lateral or vertical direction.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. An apparatus for restraining an object comprising:

a rigid launching canister, the rigid launching canister configured for fixation to a ship or submarine;

a structural collar attached to the launching canister, the structural collar having a perimeter and thickness wherein the structural collar has an inside surface and an outside surface;

the inside surface of the structural collar has at least one recessed groove;

at least one inflatable bladder lying within the at least one recessed groove; and at least one interference member attached to the inside surface of the structural collar.

2. The apparatus for restraining an object of claim 1 wherein the at least one inflatable bladder is not continuous.

3. The apparatus for restraining an object of claim 1, wherein the launching canister comprises a missile launching canister.

4. The apparatus for restraining an object of claim 1, wherein the interference member is radially adjustable.

5. An apparatus for restraining an object comprising:

a structural collar configured for attachment to a rigid launching canister, the rigid launching canister configured for fixation to a ship or submarine, the structural collar comprising a perimeter and thickness wherein the structural collar has an inside surface and an outside surface;

the inside surface of the structural collar comprising at least one recessed groove;

at least one inflatable bladder positioned within the at least one recessed groove; and at least one interference member attached to the inside surface of the structural collar.

6. The apparatus for restraining an object of claim 5, wherein the at least one inflatable bladder is not continuous.

7. The apparatus for restraining an object of claim 5, wherein the launching canister comprises a missile launching canister.

8. The apparatus for restraining an object of claim 5, wherein the interference member is radially adjustable.

* * * * *